US010206476B1

(12) United States Patent
Newell

(10) Patent No.: US 10,206,476 B1
(45) Date of Patent: Feb. 19, 2019

(54) APPARATUS AND METHOD FOR COLORING OR LIGHTENING HAIR

(71) Applicant: James Newell, Fort Lauderdale, FL (US)

(72) Inventor: James Newell, Fort Lauderdale, FL (US)

( * ) Notice: Subject to any disclaimer, the term of this patent is extended or adjusted under 35 U.S.C. 154(b) by 0 days.

(21) Appl. No.: 14/849,110

(22) Filed: Sep. 9, 2015

Related U.S. Application Data

(60) Provisional application No. 62/099,244, filed on Jan. 2, 2015.

(51) Int. Cl.

| | |
|---|---|
| ***A45D 19/00*** | (2006.01) |
| ***D21H 19/84*** | (2006.01) |
| ***D21H 19/32*** | (2006.01) |
| ***D21H 19/36*** | (2006.01) |

(52) U.S. Cl.
CPC ..... *A45D 19/0025* (2013.01); *D21H 19/32* (2013.01); *D21H 19/36* (2013.01); *D21H 19/84* (2013.01); *A45D 2019/0091* (2013.01)

(58) Field of Classification Search
CPC ..... A45D 19/0025; A45D 2019/0066; D21H 19/32; D21H 19/84
See application file for complete search history.

(56) References Cited

U.S. PATENT DOCUMENTS 5,816,268 A * 10/1998 Awaijane ..... A45D 19/0025 132/208

* cited by examiner

*Primary Examiner* — Eisa B Elhilo
(74) *Attorney, Agent, or Firm* — David P. Lhota; Lhota & Associates, P.A.

(57) ABSTRACT

A paper device for coloring, highlighting, lowlighting and lightening hair that includes a pad having a plurality of sheets of water dissolvable and biodegradable paper wherein each sheet of paper has a first surface and a second surface; a plurality of colors, a lightener, highlighting agent or low lighting agent on the first surface; an inhibitor on the first surface; a coating of silicone on the second surface to prevent the bleeding of color through the sheet; and a water soluble adhesive strip on the second surface for securing the sheet on a client's hair. Each sheet may also have a heat seal coating applied to either surface that allows the sheet to be made into a dissolvable pouch, cone, corkscrew or other desirable shape. The colors may be used in organic or inorganic dyes, hennas, colors, stains or lighteners and may be infused, coated, imbibed or applied to the sheet using a tint brush or spray.

20 Claims, 5 Drawing Sheets

APPARATUS AND METHOD FOR COLORING OR LIGHTENING HAIR

CROSS-REFERENCE TO RELATED APPLICATION

This application claims the benefit of provisional parent application Ser. No. 62/099,244 filed Jan. 2, 2015

STATEMENT REGARDING FEDERALLY SPONSORED RESEARCH OR DEVELOPMENT

N/A

FIELD OF THE INVENTION

The present invention relates to an apparatus and a method for hair coloring and lightening, and, more particularly to such an apparatus and such a method by which a hair coloring, highlight, lowlight or lightening material is applied to selected portions of the hair, with water dissolvable and biodegradable paper covered with hair coloring and, or lightener and applied to the hair using an activator.

BACKGROUND OF THE INVENTION

Traditional methods for hair coloring and lightening hair have been used for thousands of years, when materials such as henna, indigo, sage, and chamomile were used. In the Roman Empire, dark haired women who admired the blonde hair of female slaves lightened their own hair using saffron, red arsenic, nut shells, and plant ash. In the latter part of the Nineteenth Century synthetic dyes came into use for hair coloring, and hydrogen peroxide came into widespread use as a bleaching agent.

While it is relatively easy to change the color of a person's hair as a whole by dyeing or bleaching, the results of applying such a process uniformly to all of the hair are generally disappointing and difficult, with the hair acquiring an uninteresting non-uniform color. Conventional methods include measuring and mixing hair color or lightening with a developer in a mixing bowl or applicator bottle. The hair color or lightener is then applied to the hair with a tint brush or applidqto4 bottle. This method is messy when mixing and applying it to one's hair, resulting in unpredictable color results. It is also very difficult to store, transport and clean up hair coloring and lighteners. Therefore, such a process is generally followed by another step, in which selected portions of the hair are lightened, in a process known as streaking, or darkened, in a process known as reverse streaking.

The method most commonly used today for coloring selected portions of the hair is the foil method, in which the stylist isolates a strand of hair to lie along the upper surface of a sheet of foil having an edge held against the head near the roots of the strand of hair. The selected strand is then treated by the application of coloring material, being isolated from adjacent portions of the hair with the foil, and the foil is then folded around the strand to continue providing a barrier preventing migration of the coloring material to other parts of the hair during time necessary to provide the desired treatment.

One problem with the foil method arises from the cost of the large number of foil sheets that must be used to treat the hair of an individual and from the space required for their disposal or the costs of recycling the material. Foil makes up approximately fifty percent (50%) of color salon waste. The time required for the completion of the process is also disadvantageous in its effects on the cost of the process and on the discomfort of the individual whose hair is being treated. Furthermore, since the strands of hair being treated are covered by the foil, it is difficult for the stylist using this method to track the progress of the treatment, often resulting, for example, in the over bleaching of certain strands of hair being streaked.

Before the strands of hair can be pace d on individual foil panels and treated with coloring materials, the hair must be separated into strands. For example, this is done by weaving the hair using an ordinary rattail comb, having a comb section with ordinary teeth from which a pointed extension, or rattail, extends. The comb section is used to shape each strand, and the strands are individually placed to extend across alternating sides of the rattail, in a woven fashion.

Given the shortcomings with conventional methods for coloring and lightening hair, there exists a need for a device and method for coloring or lightening hair that provides predictable, uniform results, that does not require messy measuring and mixing bowls, eliminates the need for foil, is easy to clean up, dissolves with tap water, washes safely down the drain, and that is biodegradable and environmentally safe. It is, therefore, to the effective resolution of the aforementioned problems and shortcomings of the prior art that the present invention is directed. The instant invention addresses this unfulfilled need in the prior art by providing a device and method for coloring and lightening hair with dissolvable and biodegradable paper products as contemplated by the instant invention disclosed herein.

SUMMARY OF THE INVENTION

In light of the foregoing, it is an object of the present invention to provide a hair treatment paper device for coloring, highlighting, lowlighting or lightening hair with water dissolvable and biodegradable paper.

It is also an object of the instant invention to provide a water dissolvable paper device for coloring, highlighting, lowlighting or lightening hair that eliminates the need or use of foil.

It is another object of the instant invention to provide a method for coloring, highlighting, lowlighting or lightening hair with water dissolvable paper that may be used by professionals or nonprofessionals.

It is an additional object of the instant invention to provide a method for coloring, highlighting, lowlighting or lightening hair with biodegradable paper.

It is a further object of the instant invention to provide a hair treatment water dissolvable paper device and method for coloring highlighting, lowlighting or lightening hair that provides for uniform color in the hair.

It is yet another object of the instant invention to provide a hair treatment water dissolvable paper device and method for coloring highlighting, lowlighting or lightening that saves time.

It is yet a further object of the instant invention to provide a hair treatment water dissolvable paper device and method for coloring highlighting, lowlighting or lightening that does not require messy measuring and mixing bowls and provides for a much cleaner process than conventional methods.

It is yet an additional object of the instant invention to a provide hair treatment water dissolvable paper device and method for coloring highlighting, lowlighting or lightening that dissolves with tap water, washes safely down the drain and is environmentally safe and ecological.

In accordance with one aspect, the present invention provides a paper device for coloring, highlighting, lowlighting and lightening hair that includes at least one sheet of water dissolvable and biodegradable paper having first surface and a second surface, at least one color or lightener on the first surface, an inhibitor on the first surface, a coating of silicone on the second surface to prevent the bleeding of color through the sheet, and an adhesive strip on the second surface for securing the sheet on a client's hair. The present invention may also include an activator.

In another aspect, the present invention provides a paper device for coloring, highlighting, lowlighting and lightening hair that includes a pad having a plurality of sheets of water dissolvable and biodegradable paper wherein each sheet of paper has a first surface and a second surface; a plurality of colors, a lightener, highlighting agent or lowlighting agent on the first surface; an inhibitor on the first surface; a coating of silicone on the second surface to prevent the bleeding of color through the sheet; and a water soluble adhesive strip on the second surface for securing the sheet on a client's hair. Each sheet may also have a heat seal coating applied to either surface to make it more firm so that the sheet may be made into a dissolvable pouch, cone, corkscrew or other desirable shape. The colors may be used in organic or inorganic dyes, hennas, colors, stains or lighteners and may be infused, coated, imbibed or applied to the sheet using a tint brush.

In an additional aspect, the present invention provides a method for coloring, highlighting, lowlighting and lightening hair selecting at least one sheet of water dissolvable and biodegradable paper having first surface and a second surface, at least one desired color or lightener on the first surface, an inhibitor on the first surface, a coating of silicone on the second surface to prevent the bleeding of color through the sheet, and an adhesive strip on the second surface for securing the sheet on hair, applying at least one sheet of paper to a client's hair with the adhesive strip down so it adheres to the hair and first surface up, placing and laying at least one strand of a client's hair of the first surface, applying an activator to the sheet and, after processing, rinsing the client's hair until the at least one sheet dissolves.

In accordance with these and other objects, which will become apparent hereinafter, the instant invention will now be described with particular reference to the accompanying drawings.

DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

With reference to the drawings in which like reference designators refer to like elements, FIGS. 1 to 8 depict the preferred embodiment of the instant invention which is generally referenced as a hair treatment device, system or method and, or by numeric character 10. The hair treatment device, system and method 10 of the instant invention is used for coloring or lightening a person's hair. The instant invention 10 is biodegradable and environmentally friendly. It avoids the mess of conventional hair coloring and lightening systems, does not require the mixing of colors and requires little to no cleanup. The instant invention may also be used with other hair products, such as shampoo, conditioner and gel.

Figure 1:
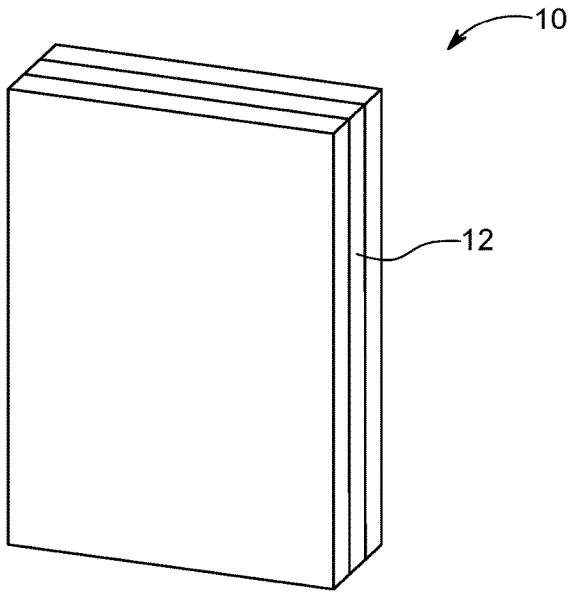
FIG. 1 is a front perspective view of the hair coloring and lightening device showing a plurality of hair treatment sheets in a pad in accordance with the preferred embodiment of the instant invention.
Figure 2:
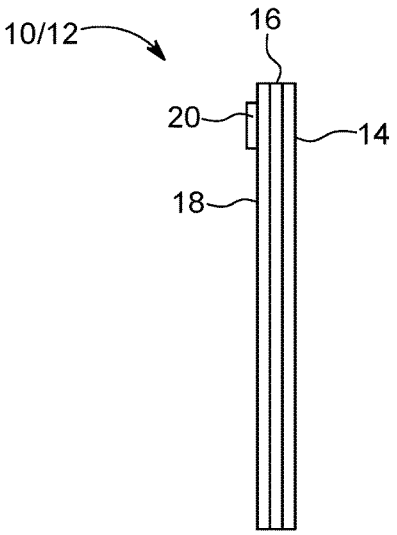
FIG. 2 is a side elevational view of a hair treatment sheet of the instant invention shown in FIG. 1.
Figure 3:
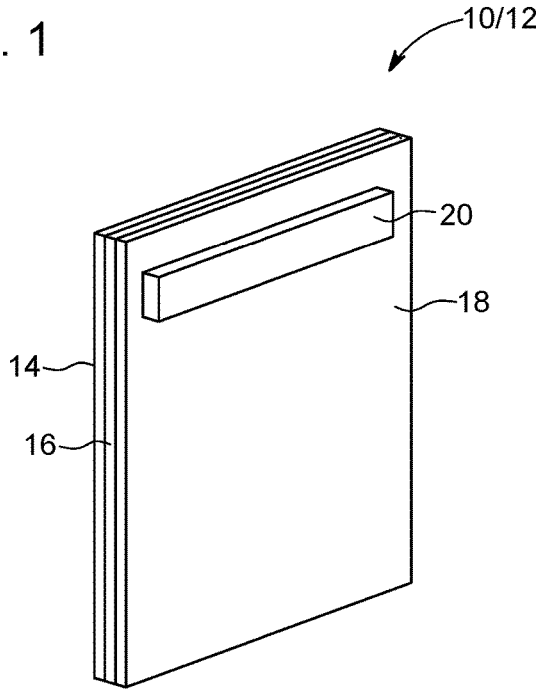
FIG. 3 is a rear perspective view of a hair treatment sheet in accordance with the instant invention of FIG. 1.
Figure 4:
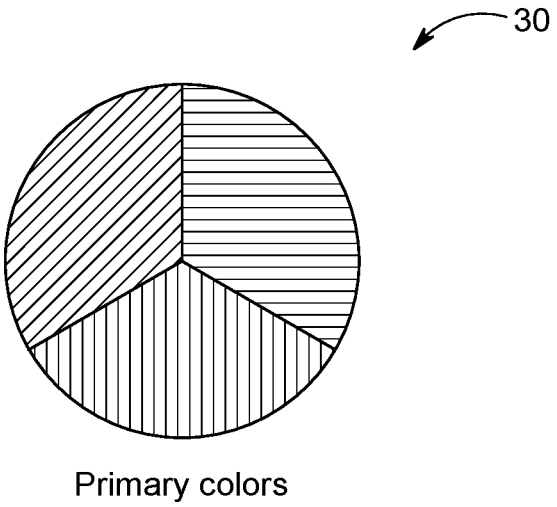
FIG. 4 shows the primary colors that may be used individually or in combination on a hair treatment sheet for coloring hair in accordance with the instant invention of FIG. 1.
Figure 5:
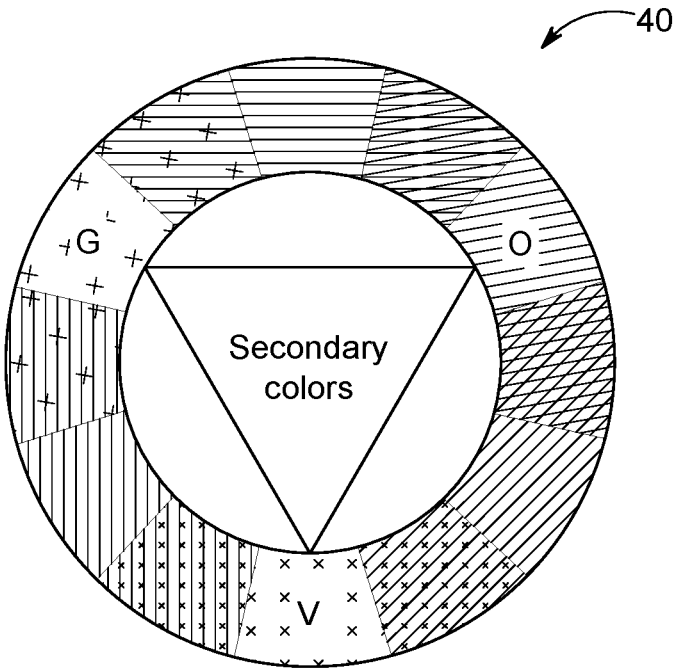
FIG. 5 shows the secondary colors that may be used individually or in combination on a hair treatment sheet for coloring hair in accordance with the instant invention in FIG. 1.
Figure 8:
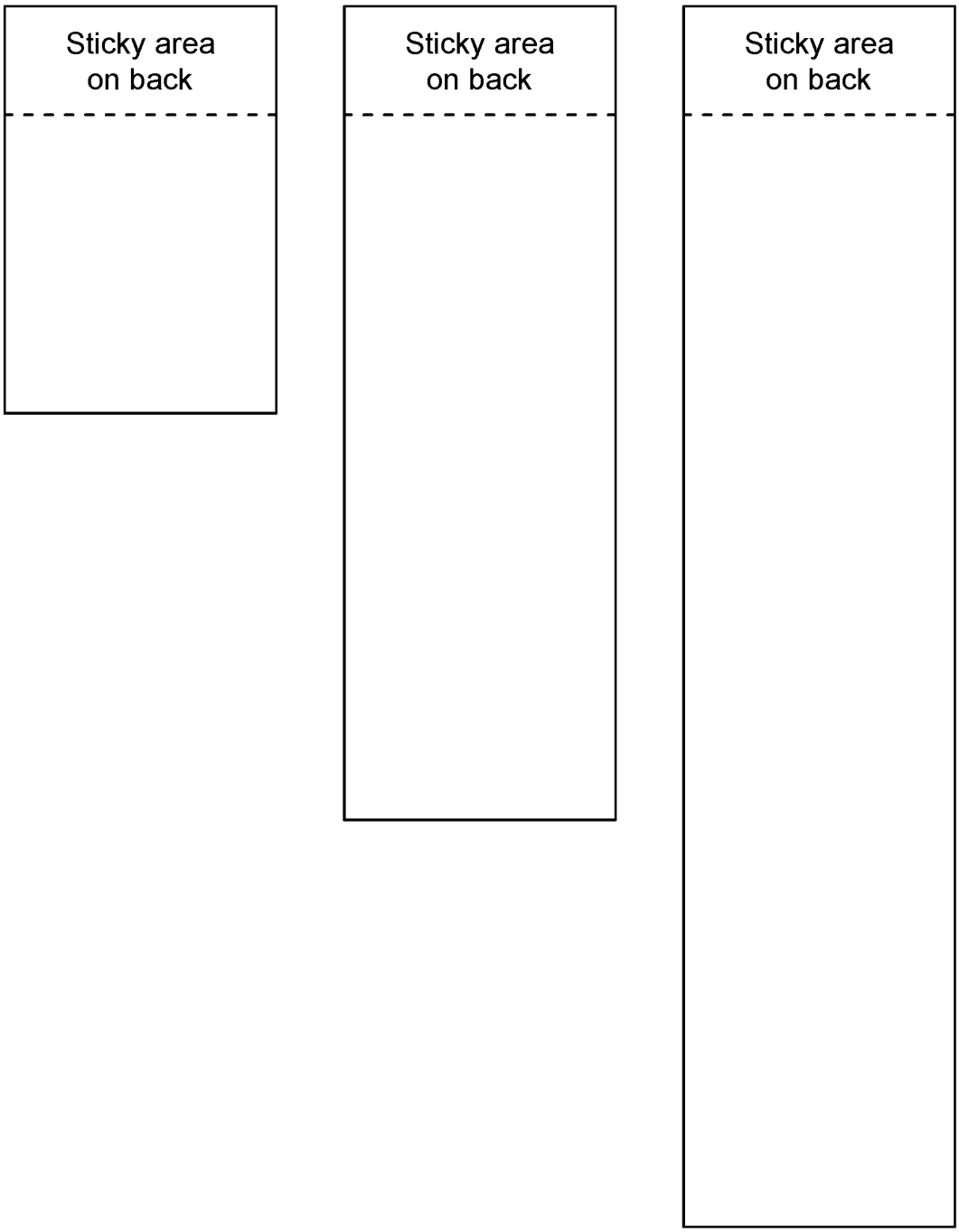
FIG. 8 is rear elevational views of hair treatment sheets of FIG. 1 showing the showing the sheets having different dimensions.

With reference to FIG. 1, the hair treatment system 10 comprises a pad having a plurality of hair treatment sheets 12. The hair treatment sheets 12 are water dissolvable paper and stick together with an adhesive strip 20, shown in FIGS. 2-3, to form a pad. The pad makes it convenient for accessing and removing hair treatment sheets 12 for use on treating hair. Referring to FIGS. 2-3, the hair treatment sheets 12 comprises a front surface that is covered with hair color and, or lightener 14 and with conditioners. The rear surface of the hair treatment sheets 12 are covered with a thin coating of silicone to inhibit the bleeding of colors or inhibiters through the sheet 12 of dissolvable paper. The sheet 12 may be designed in a variety of lengths or dimensions, as shown in FIG. 8, or in a variety of shapes, such as square, circular, triangular, oblong or random. In an alternative embodiment, the sheets 12 may be a non -dissolvable paper.

Figure 9:
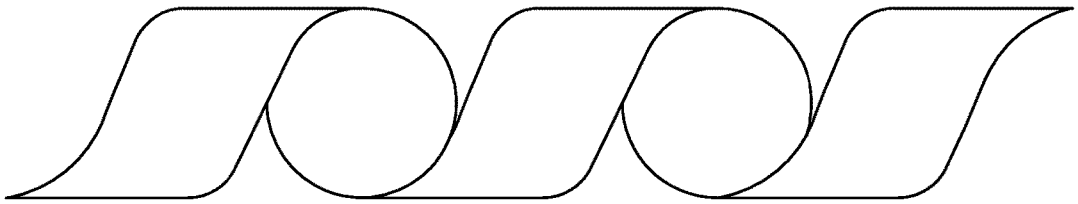
FIG. 9 is an elevational view of a hair treatment sheet of the instant invention shown in FIG. 1 formed into a corkscrew.
Figure 10:
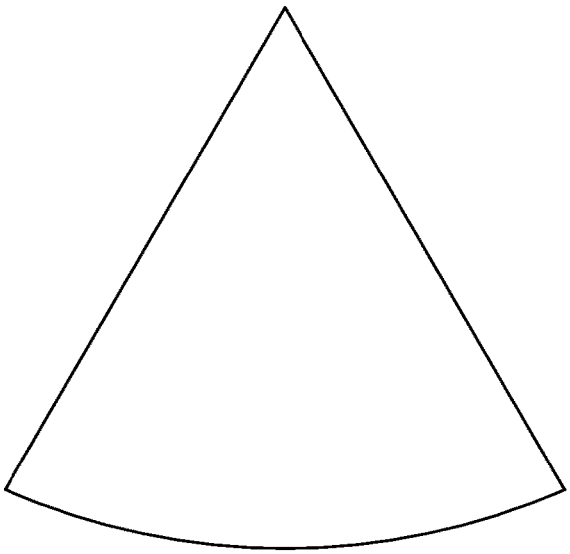
FIG. 10 is an elevational view of a hair treatment sheet of the instant invention shown in FIG. 1 formed into a cone.

The hair treatment sheets 12 preferably comprise a water dissolvable or soluble paper made or marketed by Daymark Technologies or comparable substitute. The water soluble paper is made of a combination of sodium carboxy methyl cellulose and wood pulp or comparable substitutes. The paper sheets 12 dissolve in water in seconds making it instantly biodegradable. This dissolving material can be made in a variety of thicknesses and coatings, which makes it useful with the instant invention 10. The paper sheets 12 can be coated with a water soluble adhesive, such as to make the adhesive strip 20, which dissolves in water or steam and leaves behind no adhesive residue. The paper sheet can also have heat seal coating applied that allows the material to be made into a dissolvable pouch, corkscrew, cone or other desired shape as shown in FIGS. 9 and 10.

Figure 6:
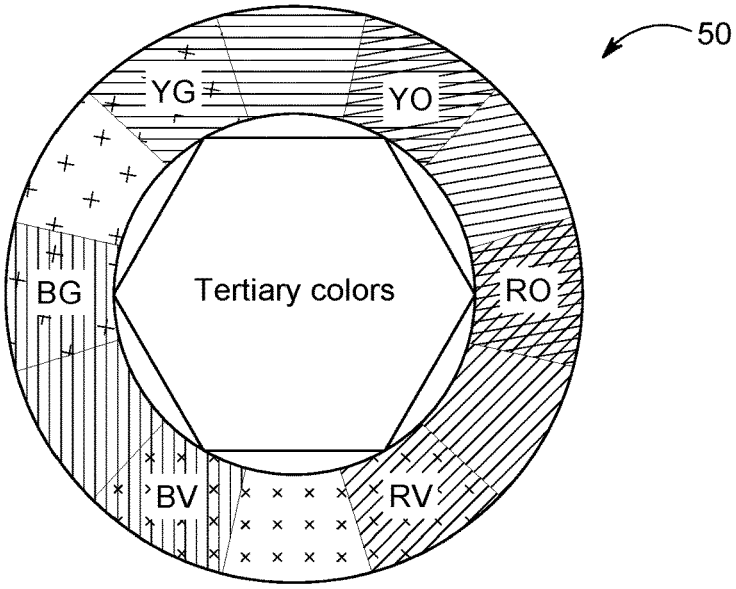
FIG. 6 shows the tertiary colors that may be used individually or in combination on a hair treatment sheet for coloring hair in accordance with the instant invention of FIG. 1.
Figure 7:
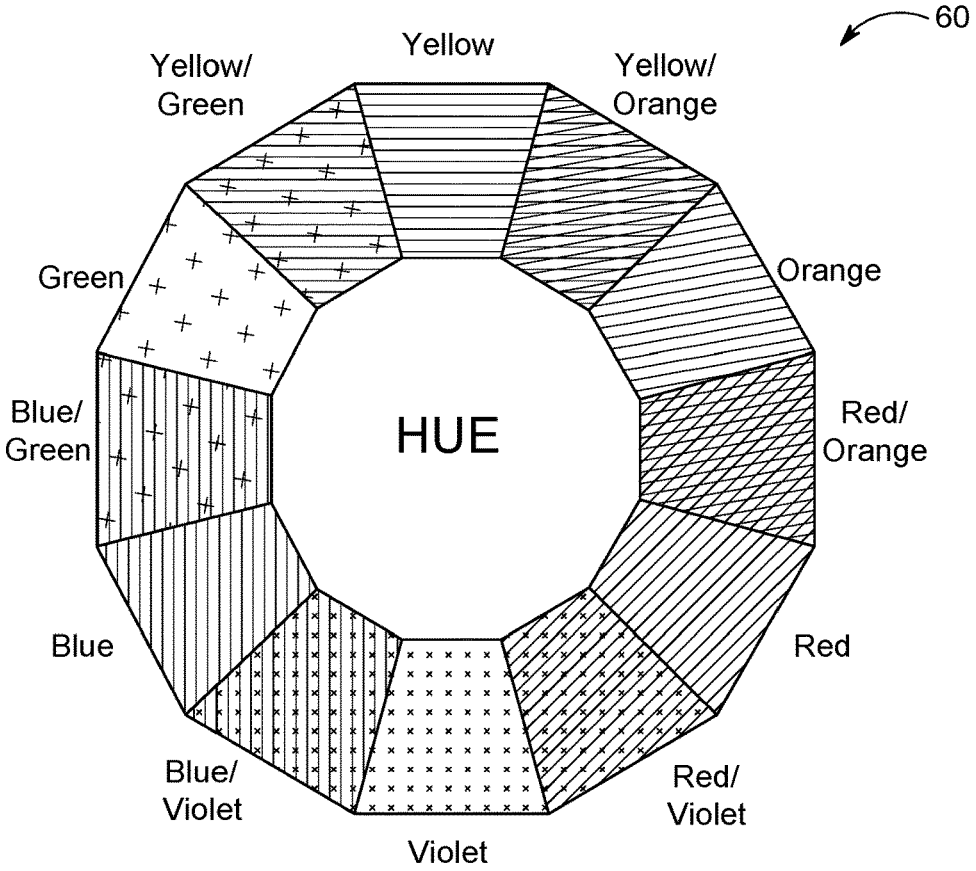
FIG. 7 shows a color wheel of various hues that may be used individually or in combination on a hair treatment sheet for coloring hair in accordance with the instant invention of FIG. 1.

With reference to FIGS. 4-7, a variety of colors 30-60 may be used in organic or inorganic hair dyes, hennas, colors, stains and lighteners with the instant invention 10. The colors or lighteners 30-60 may be infused, coated, imbibed or applied with a tint brush onto a sheet 12 and may include dyes, hennas, lighteners, stirs, pigments or powdered hair lightener. Colors may be selected from the primary colors 30 (red, yellow and blue) from which all colors are derived. Alternatively, colors may be selected from the secondary colors 40 which are derived from combining two of the primary colors 30 and include green, orange, violet and shades of yellow, orange, red, green, violet and blue. Tertiary colors 50 may also be used, as shown in FIG. 6, or any combination of colors 60 shown in the color wheel in FIG. 7, such as green, yellow, orange, red, red-violet, violet, blue, blue-violet and shades of yellow, orange, red, blue, green and violet. It is important to note that any combination of colors or lighteners may be used with the instant invention 10. In addition, a hair treatment sheet 12 may have more than one color or lightener, may include stripes, designs or any combination of colors and arrangements.

To use the instant invention 10, the first step is to select the sheet 12 with the desired shade, color or lightener and oriented into proper position, paying close attention to the hair lines and parts. The hair treatment sheet 12 is applied to a client's hair with the adhesive strip 20 down and against the head or scalp and the color or lightener side 14 facing up and out. Once a hair treatment sheet 12 is in place, a segment of hair or hair strand is placed and laid on top of the color side 14 of the sheet 12. An activator is then applied, such as by a tint brush or a spray, so as to completely cover and wet the sheet 12. This is repeated with as many sheets as required wherein additional sheets 12 may be applied as desired in selected spatial orientation and colors to achieve the desired look. Once the hair coloring or lightening process is completed, the client's hair is rinsed and the hair treatment sheets 12 dissolve and wash down the drain.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A hair treatment device for coloring, highlighting, lowlighting, or lightening a person's hair with a hair treatment solution, the device comprising:

at least one sheet of paper having a first surface and a second surface, a hair treatment solution on said first surface;

an inhibitor on said first surface;

a silicone coating on said second surface to prevent said hair treatment solution from bleeding through said sheet; and an adhesive strip on said second surface for securing said sheet to a person's hair.

2. A device as recited in claim 1, wherein said sheet of paper comprises:

a water dissolvable sheet of paper.

3. A device recited in claim 2, further comprising:

a pad having a plurality of said sheets; and said hair treatment solution comprising at least one color on at least one sheet of said plurality sheets.

4. A device as recited in claim 3, wherein said treatment solution comprises a highlighter on at least one sheet of said plurality of sheets.

5. A device as recited in claim 3, wherein said hair treatment solution comprises a lowlighter on at least one sheet of said plurality of sheets.

6. A device as recited in claim 3, wherein said hair treatment solution comprises a lightener on at least one sheet of said plurality of sheets.

7. A device as recited in claim 3, wherein said hair treatment solution comprises an activator on at least one sheet of said plurality of sheets.

8. A device as recited in claim 3, wherein said hair treatment solution comprises at least one color on each of said plurality sheets.

9. A device as recited in claim 8, wherein said color is organic.

10. A device as recited in claim 1, further comprising a heat seal coating applied to at least one of said surfaces for allowing said sheet to form a pouch, cone, corkscrew or other desired shape.

11. A device as recited in claim 3, wherein said hair treatment solution comprises a highlighter on said paper.

12. A device as recited in claim 3, wherein said hair treatment solution comprises a lowlighter on said paper.

13. A device as recited in claim 3, wherein said hair treatment solution comprises a lightener on said paper.

14. A device as recited in claim 1, wherein said hair treatment solution comprises an activator on said paper.

15. A device as recited in claim 1, wherein said adhesive strip is water soluble.

16. A device as recited in claim 1, wherein said sheet is biodegradable.

17. A device as recited in claim 1, wherein said sheet comprises a combination of sodium carboxy methyl cellulose and wood pulp.

18. A device as recited in claim 1, further comprising an activator on said paper.

19. A method for coloring, highlighting, lowlighting or lightening a person's hair with a hair treatment solution, said method comprising the steps of:

providing at least one sheet of water dissolvable paper having a first surface and a second surface, a hair treatment solution on said first surface, an inhibitor on said first surface; a silicone coating on said second surface to prevent said hair treatment solution from bleeding through said sheet and an adhesive strip on said second surface for securing said sheet to a person's hair;

placing said at least one sheet on a client's hair such that said adhesive strip engages the client's hair;

placing at least one strand of the person's hair on said first surface;

applying an activator to said first surface:

rinsing said sheet with water until said sheet dissolves.

20. A method as recited in claim 19, wherein said hair treatment solution comprises at least one color, a highlighter, lowlighter or a lightener.

* * * * *